US005905238A

United States Patent [19]

Hung

[11] Patent Number: 5,905,238

[45] Date of Patent: May 18, 1999

[54] ELECTRICAL SWITCH CAPABLE OF EMITTING LIGHT

[76] Inventor: Wen-Hui Hung, 2F, No. 98, Lane 1, Sec. 2, Chung San Road, Pan Chiao City, Taipei Hsien, Taiwan

[21] Appl. No.: 09/014,913

[22] Filed: Jan. 28, 1998

[51] Int. Cl.[6] ..... H01H 9/16

[52] U.S. Cl. ..... 200/314; 200/213

[58] Field of Search ..... 200/4, 11 R–11 K, 200/308–317, 336, 341, 529, 564, 566, 570

[56] References Cited

U.S. PATENT DOCUMENTS

| | | | |
|---|---|---|---|
| 4,176,265 | 11/1979 | Mobus et al. | 200/316 |
| 4,245,141 | 1/1981 | Aspden | 200/314 |
| 4,985,605 | 1/1991 | Valenzona | 200/528 |
| 5,252,794 | 10/1993 | Tseng | 200/51.15 |
| 5,581,059 | 12/1996 | Chang | 200/11 G |
| 5,586,645 | 12/1996 | Bartok | 200/527 |
| 5,811,745 | 9/1998 | Hung | 200/11 R |

*Primary Examiner*—Michael A. Friedhofer
*Attorney, Agent, or Firm*—Browdy and Neimark

[57] ABSTRACT

An electrical switch capable of emitting light is composed of a base, a conductive disk, a switching conductive piece, a first and a second fastening conductive pieces, a cap, a rotating mechanism, and a light-emitting diode. The conductive disk is located in a receiving cell of the base such that the conductive disk is fastened with the switching conductive piece. The first and the second fastening conductive pieces are connected with an electrical device. The cap is pervious to light and is joined with the base. The rotating mechanism is composed of a rotary piece and a link column. The light-emitting element is connected with the first and the second fastening conductive pieces which can be connected or disconnected with the switching conductive piece by triggering the link column to actuate the rotary piece capable of driving the conductive disk.

6 Claims, 3 Drawing Sheets

ELECTRICAL SWITCH CAPABLE OF EMITTING LIGHT

FIELD OF THE INVENTION

The present invention relates generally to an electrical switch, and more particularly to an electrical switch capable of emitting light.

BACKGROUND OF THE INVENTION

The conventional electrical switch is incapable of emitting light and is therefore difficult to be found in the dark place where the electrical appliances or the lighting fixtures are located. Accordingly the conventional electrical switch can be rather inconvenient and hazardous.

SUMMARY OF THE INVENTION

The primary objective of the present invention is to provide an electrical switch capable of emitting light at such time when the electrical switch is located at the "OFF" position.

In keeping with the principle of the present invention, the foregoing objective of the present invention is attained by the electrical switch consisting of a base, a conductive disk, a switching conductive piece, a first and a second fastening conductive pieces, a cap, a rotating mechanism, and a light-emitting element. The conductive disk is located in a receiving cell of the base such that the conductive disk is in contact with the switching conductive piece. The first and the second fastening conductive pieces are located in the base and are connected with an electrical appliance to form a current loop. The cap is pervious to light and is joined with the base. The rotating mechanism is composed of a rotary piece and a link column which is received in the cap. The rotary piece is engaged with the conductive disk. The light-emitting element is disposed in the receiving cell of the base such that the light-emitting element is connected at both ends thereof with the first and the second fastening conductive pieces, and that the light-emitting element emits light when the electrical switch is located at the "OFF" position, and further that the light-emitting element does not emit light when the electrical switch is located at the "ON" position.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
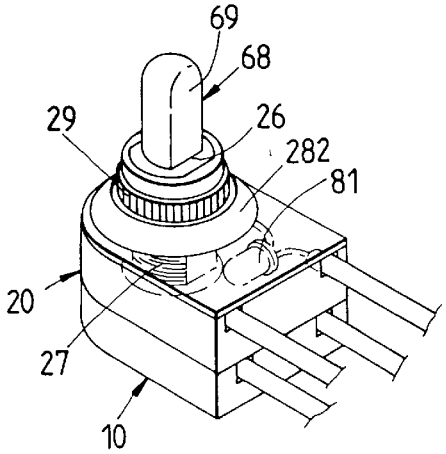
FIG. 1 shows a perspective view of a first preferred embodiment of the present invention.
Figure 2:
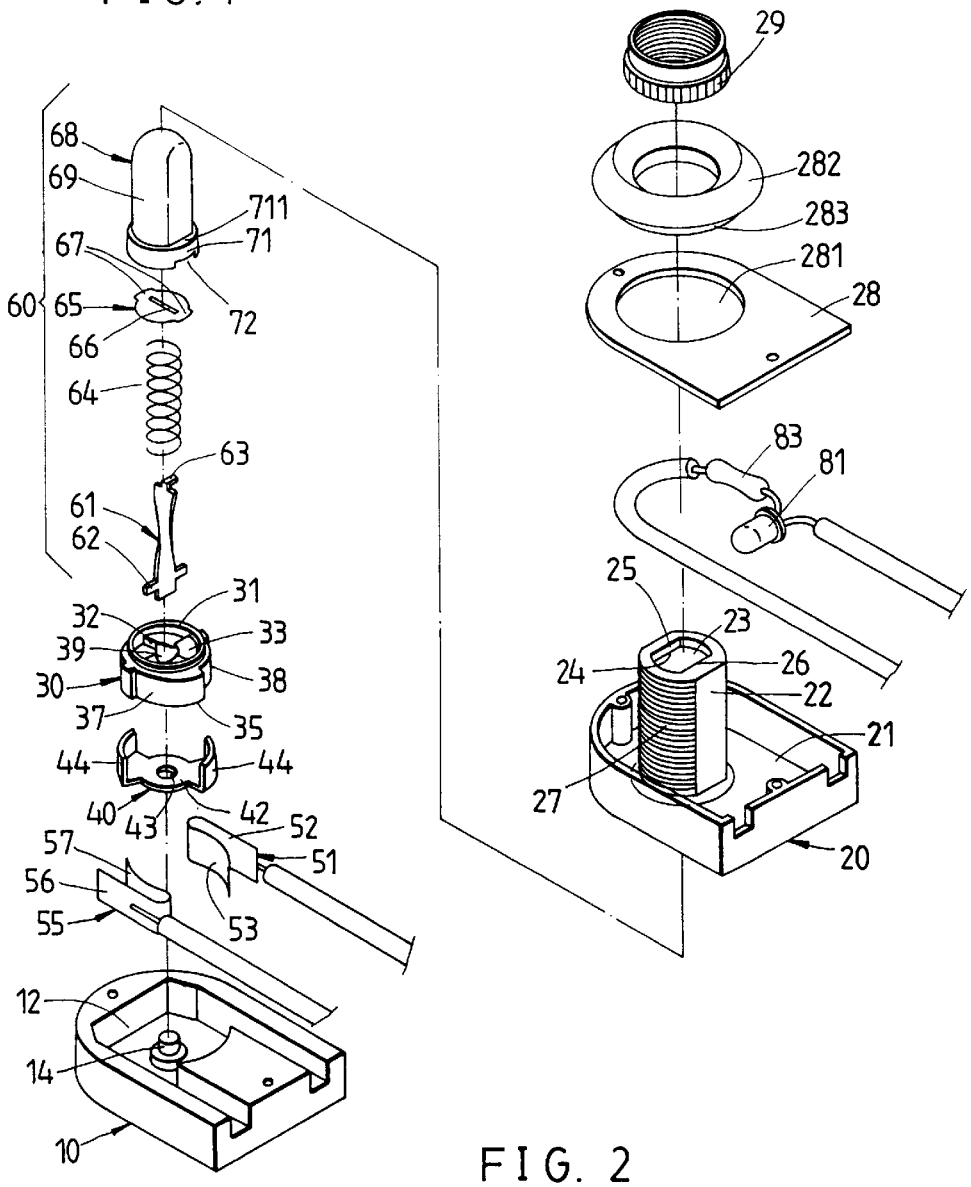
FIG. 2 shows an exploded view of the first preferred embodiment of the present invention.

As shown in FIGS. 1 and 2, an electrical switch of the first preferred embodiment of the present invention is composed of the component parts, which are described explicitly hereinafter.

A base 10 is provided with a receiving cell 12 having an opening and a column 14 located at the center of the receiving cell 12.

A container 20 is pervious to light and is provided with a receiving compartment 21 which is provided at the center thereof with a hollow column 22. The hollow column 22 is provided in the top thereof with a through hole 23 which is in turn provided along the edge therof with a circular shoulder 24 and two opposite tangent planes 25 and 26. The hollow column 22 is provided with an outer threaded portion 27.

A flat platelike cap 28 is pervious to light and is provided with a through hole 281 which has a hole diameter slightly greater than the outer diameter of the hollow column 22 of the container 20. The cap 28 is joined with the container 20 such that the cap 28 covers the receiving compartment 21 of the container 20, and that the hollow column 22 is put through the through hole 281. The cap 28 is provided with a refractive ring 282, which has a connection ring 283. The refractive ring 282 is fastened with the cap 28 such that the connection ring 283 is lodged in the space located between the through hole 281 and the hollow column 22, and that the refractive ring 282 and the cap 28 are fastened securely with the container 20 by a nut 29, which is engaged with the threaded portion 27 of the hollow column 22.

A conductive disk 30 has an upper disk face 31, a lower disk face 35, and a side ring face 37. The upper disk face 31 is provided with four stepped portions 32 and a tapered face 33 located between two stepped portions 32. The side ring face 37 is provided with two insertion slots 38. The conductive disk 30 is provided at the center thereof with a through hole 39.

A switching conductive piece 40 has a bottom 42, which is attached to the lower disk face 35 of the conductive disk 30. The bottom 42 is provided with a through hole 43 and two lugs 44 which are engaged with the insertion slots 38 of the conductive disk 30. The switching conductive piece 40 and the conductive disk 30 are joined together such that they can be rotated on the column 14 which is engaged with the through holes 39 and 43.

A first fastening conductive piece 51 and a second fastening conductive piece 55 are provided respectively with a flat straight portion 52 (56), and an arcuate portion 53 (57) extending from the flat straight portion 52 (56) in opposite directions. The first and the second fastening conductive pieces 51 and 55 are disposed in the receiving cell 12 and are located respectively on both sides of the conductive disk 30 in such a manner that the arcuate portions 53 and 57 are fastened with the side ring face 37 of the conductive disk 30.

A press-type rotating mechanism 60 consists of a rotary piece 61 of a spiral construction and having two wings 62 and a folded side 63. The wings 62 are connected with the stepped portions 32 of the conductive disk 30 and a coil spring 64 which is engaged at one end thereof with a strip hole 66 of an urging piece 65. The urging piece 65 is provided with two arresting lugs 67 opposite to each other. A press column 68 has a hollow column 69, a protruded edge 71, two recesses 72 opposite to each other. The hollow column 69 is jutted out of the hollow column 22 of the container 20 via the through hole 23. The arresting lugs 67 of the urging piece 65 are retained in the recesses 72. The press column 68 is urged by the coil spring 64 such that the circular shoulder 711 of the protruded edge 71 is in contact with the circular shoulder 24 of the through hole 23.

Figure 3:
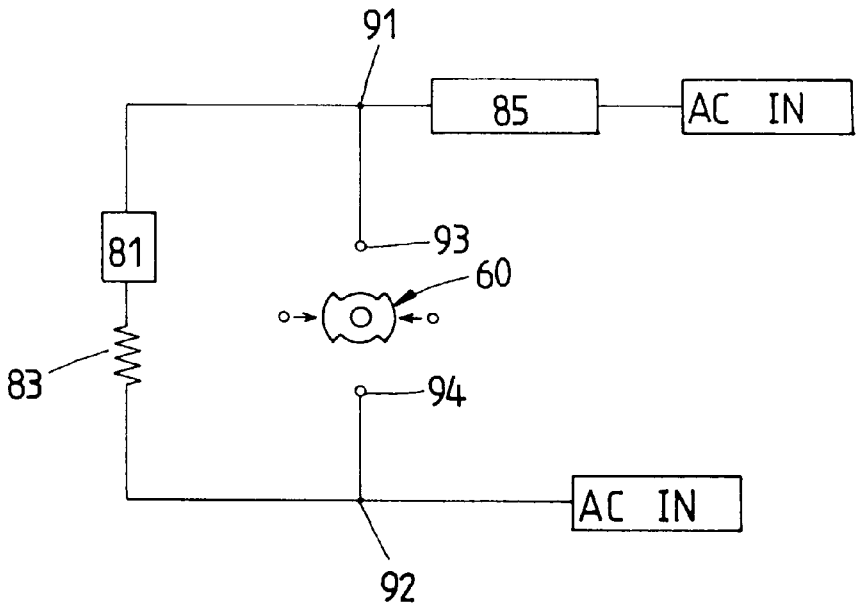
FIG. 3 shows a schematic view of the first preferred embodiment of the present invention in conjunction with a circuit of a lighting fixture.

As shown in FIG. 3, the electrical switch of the present invention is connected with a lighting fixture 85. The present invention has features, which are described hereinafter.

The light emitting element of the present invention is a light-emitting diode 81, which is located in the receiving compartment 21 of the container 20 such that the diode 81 is connected at one end thereof with one end of a resistance 83 and at another end thereof with a pin 91. The resistance 83 is connected at another end thereof with a pin 92. The lighting fixture 85 is connected at one end thereof with the pin 91 and at another end thereof with an input end of the power source of alternating current. The pin 92 is connected with another input end of the alternating current power source. The pins 91 and 92 are further connected with the fastening conductive pieces 51 and 55, as shown in FIG. 2. The circuit positions of the diode 81 and the resistance 83 are interchangeable.

When the press column 68 is pressed, the urging piece 65 is actuated to move downward to force the rotary piece 61 to rotate, thereby causing the conductive disk 30 to turn an angle of 90 degrees. As a result, the lugs 44 of the switching conductive piece 40 are relocated to remain in the "OFF" or the "ON" state with each of the fastening conductive pieces 51 and 55. As shown in FIG. 3, the switch of the present invention remains in the "OFF" state such that the lugs 44 of the switching conductive piece 40 are so located that the pins 93 and 94 are not connected. As a result, the alternating current returns to the alternating current loop via the lighting fixture 85, the light-emitting diode 81 and the resistance 83. The resistances of the diode 81 and the resistance 83 are greater than the resistance of the lighting fixture 85. The voltage reduction falls on the resistance 83 and the diode 81. The diode 81 is capable of emitting light, which is radiated through the container 20 and the cap 28, and is refracted by the refractive ring 292. In view of the small voltage reduction, the lighting fixture 85 is incapable of emitting light. The electrical switch of the present invention can be easily located in a dark place, thanks to the light emitted by the diode 81.

Figure 4:
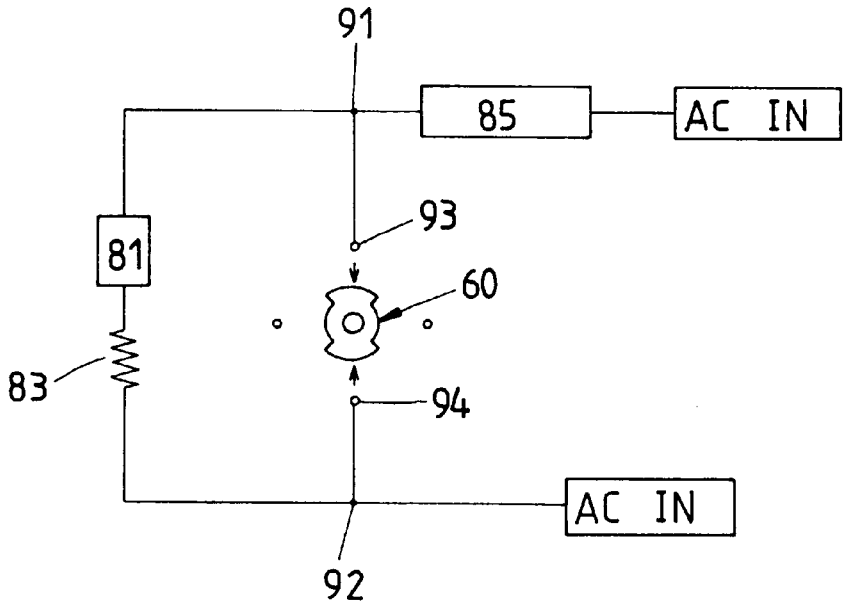
FIG. 4 shows another schematic view of the first preferred embodiment of the present invention in conjunction with the circuit of the lighting fixture.

As shown in FIG. 4, the switch of the present invention is in the "ON" state such that the pins 93 and 94 are connected in view of the position of the lugs 44 of the switching conductive piece 40. The current is made available to the lighting fixture 85. The diode 81 is incapable of emitting light.

Figure 5:
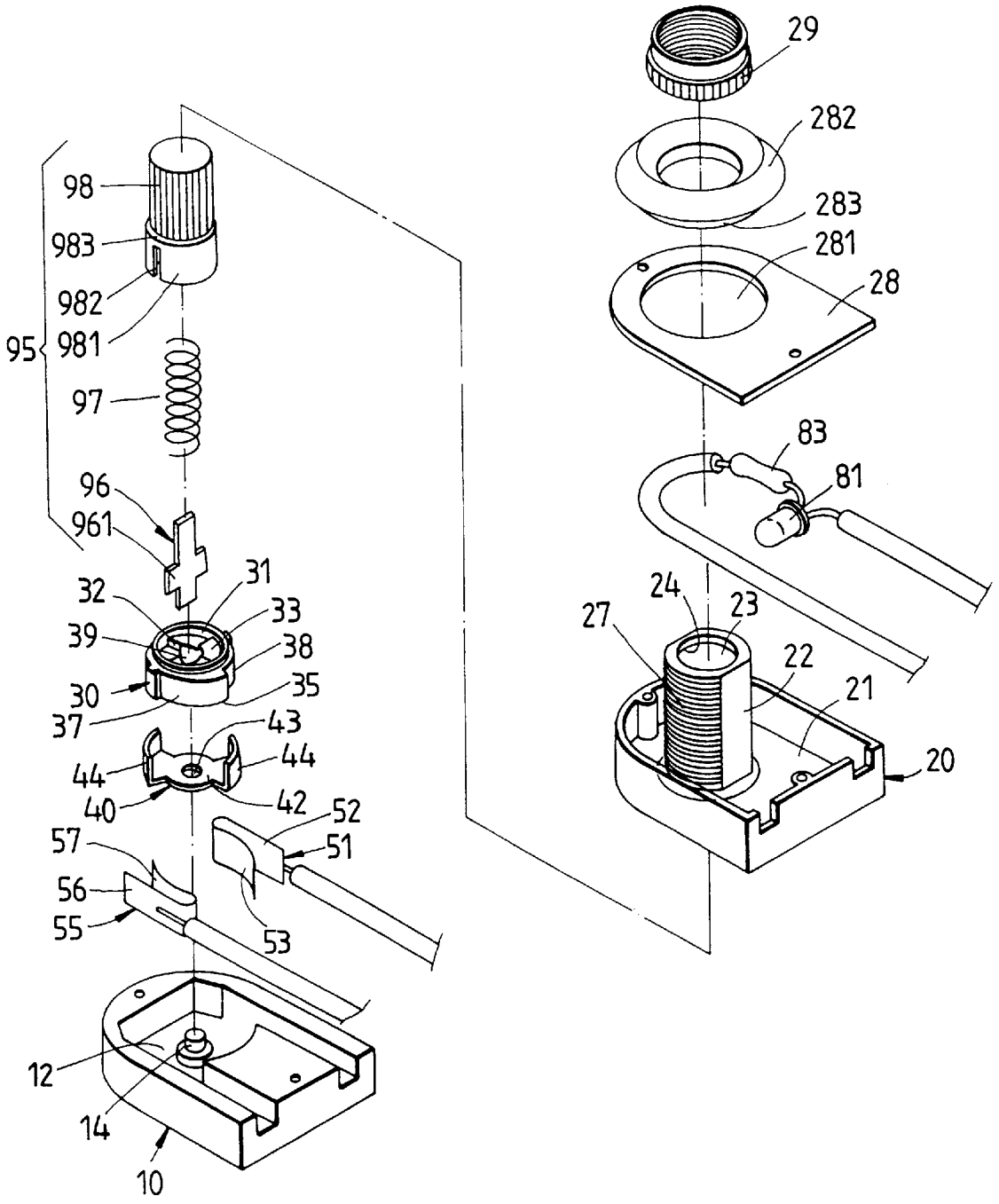
FIG. 5 shows an exploded view of a second preferred embodiment of the present invention.

As shown in FIG. 5, a second preferred embodiment of the present invention is different from the first preferred embodiment in that the former has a rotation-type rotating mechanism 95 consisting of a rotary piece 96 having two wings 961 engageable with the stepped portions 32 of the conductive disk 30 such that the wings 961 are urged by one end of a coil spring 97 which has another end urging a rotary column 98. As a result, a circular shoulder 983 of a protruded edge 981 of the rotary column 98 urges the circular shoulder 24 of the through hole 23. The rotary column 98 is jutted out of the container 20 via the through hole 23 such that the wings 961 are retained in the two recesses 982 of the rotary column 98. As the rotary column 98 is turned clockwise, the rotary piece 96 is actuated to turn likewise to drive the conductive disk 30. As a result, the "OFF" and the "ON" states are formed between the fastening conductive pieces 51 and 52. If the rotary column 98 is turned counterclockwise accidentally, the rotary piece 96 is actuated to turn likewise such that the wings 961 of the rotary piece 96 are caused to slide along the tapered face 33 of the conductive disk 30 to arrive at the stepped portions 32 without driving the conductive disk 30. A pull-type rotating mechanism is also applicable to the present invention.

What is claimed is:

1. An electrical switch capable of emitting light, said switch comprising:

a base having a receiving cell;

a conductive disk disposed in said receiving cell and composed of an upper disk face, a lower disk face, and a side ring face, said upper disk face provided with a plurality of stepped portions arranged equidistantly such that a tapered face is located between two adjoining stepped portions, said side ring face provided with at least two insertion slots;

a switching conductive piece fastened at a bottom thereof with said lower disk face of said conductive disk and provided with two lugs extending from said bottom to engage insertion slots;

a first and a second fastening conduction pieces provided respectively with a flat straight portion and a curved portion extending from one end of said flat straight portion, said fastening conductive pieces being disposed in said base and located on both sides of said conductive disk such that said first fastening conductive piece is connected with one end of a power source, and that said second fastening conductive piece is connected with one end of an electrical appliance which is in turn connected at another end thereof with another end of the electrical appliance;

a cap joined with said base and provided with a hollow column extending uprightly from a center of said cap, said cap being pervious to light;

a rotating mechanism composed of a rotary piece and a link column having a hollow body and located in said hollow column of said cap, said rotary piece being engaged with said upper disk face of said conductive disk such that said rotary piece is capable of being actuated by said link column to drive said conductive disk; and a light-emitting element disposed in said switch under said cap such that both ends of said light-emitting element are connected with said first and second fastening conductive pieces which can be connected or disconnected with said switching conductive piece by actuating said link column.

2. The switch as defined in claim 1, wherein said base is covered by a container pervious to light and having a receiving compartment said hollow column extending from a center thereof; said light-emitting element being disposed in said receiving compartment; and wherein said cap is fixed on said receiving compartment and has a through hole which passes through said hollow column.

3. The switch as defined in claim 1, wherein said rotating mechanism is a press-type rotating mechanism having the rotary piece which has a spiral construction, said rotary piece being engaged with said upper disk face of said conductive disk; wherein said link column is engaged with an urging piece fitted over said rotary piece; and wherein said urging piece and said conductive disk are provided therebetween with a coil spring fitted over said rotary piece.

4. The switch as defined in claim 1, wherein said rotating mechanism is a rotation-type rotating mechanism having the rotary piece fastened with said link column and said upper disk face of said conductive disk.

5. The switch as defined in claim 1, wherein said link column and said cap are provided therebetween with a refractive ring for refracting light emitted by said light-emitting element.

6. The switch as defined in claim 1, wherein said light-emitting element is composed of a light-emitting diode and a resistance.

* * * * *